US005372355A

United States Patent [19]

Henn et al.

[11] Patent Number: 5,372,355

[45] Date of Patent: Dec. 13, 1994

[54] TAP CLOSURE FOR A VACUUM-INDUCTION MELTING AND CASTING FURNACE

[75] Inventors: Alfred Henn, Rodenbach; Michael Schäfer, Altenstadt, both of Germany

[73] Assignee: Leybold Aktiengesellschaft, Hanau, Germany

[21] Appl. No.: 110,572

[22] Filed: Aug. 23, 1993

[30] Foreign Application Priority Data

Sep. 24, 1992 [DE] Germany ..... 4232006

[51] Int. Cl.[5] ..... B22D 41/20

[52] U.S. Cl. ..... 266/236; 222/602; 266/272

[58] Field of Search ..... 266/236, 271, 272, 237; 222/591, 602, 597

[56] References Cited

U.S. PATENT DOCUMENTS

| | | | |
|---|---|---|---|
| 668,450 | 2/1901 | McFadden | 222/602 |
| 2,113,894 | 4/1938 | Lucier | 222/602 |
| 3,744,684 | 7/1973 | Heimgartner | 222/509 |
| 4,139,050 | 2/1979 | Glaser et al. | 164/437 |
| 4,660,749 | 4/1987 | Yokoi et al. | 222/600 |
| 4,736,930 | 4/1988 | Weber et al. | 266/272 |
| 4,953,761 | 9/1990 | Fishman | 222/602 |
| 5,004,130 | 4/1991 | Vaterlaus | 222/590 |
| 5,033,658 | 7/1991 | Thornton et al. | 222/602 |
| 5,083,689 | 1/1992 | Vaterlaus | 222/602 |

FOREIGN PATENT DOCUMENTS

| | | |
|---|---|---|
| 399841 | 12/1923 | Germany . |
| 523292 | 4/1931 | Germany . |
| 6946504 | 12/1969 | Germany . |
| 2319004 | 10/1974 | Germany . |
| 3446260 | 3/1986 | Germany . |
| 2190475 | 11/1987 | United Kingdom . |

*Primary Examiner*—Scott Kastler
*Attorney, Agent, or Firm*—Felfe & Lynch

[57] ABSTRACT

An apparatus for opening and closing a bottom tap opening in a vacuum induction melting and casting furnace with a movable closing body, a plug rod for example, and a drive unit for the displacement of the closing body, the closing body being made of ceramic material and connected by levers to a coupling element, which has a compression spring to limit the maximum closing force of the closing body, and is displaceable by an electric motor drive.

15 Claims, 4 Drawing Sheets

TAP CLOSURE FOR A VACUUM-INDUCTION MELTING AND CASTING FURNACE

BACKGROUND OF THE INVENTION

The invention relates to an apparatus for opening and closing a bottom tap opening in a vacuum induction melting and casting furnace, with a movable closure body, a plug rod for example, as well as a drive unit for displacing the closure body.

There are many different tapping apparatus for melting and casting furnaces for controlling the flow of molten metals from a metallurgical vessel. For example, U.S. Pat. No. 5,083,689 describes an outlet system with a movable closure plug for controlling the flow of molten metals from a metallurgical vessel, having a control piston which is engaged in a bore and situated at the bottom end of a plug rod, and having a yoke connected with the upper end portion of the plug rod. A coupling red extending radially from the plug rod is present between the yoke and the plug rod, and for the connection between the yoke and the coupling rod at least one releasable clamping device permitting changes of angle and length is provided.

U.S. Pat. No. 4,736,930 discloses a closure system for a tap opening in the bottom of a metallurgical vessel, especially a metal melting furnace, with a shut-off means by which the tap opening can be closed from below, and which is protected against direct contact with the molten metal by a filler material placed in the tap opening. A tube is displaceable from a lowered blocking position to a raised release position releasing the tap opening, and has a protective layer of refractory material at least in the area of contact with the molten metal.

These known devices have the disadvantage that they do not allow a reliable opening and closing of the bottom pouring opening. This is especially necessary in the pouring of small amounts of high-purity metals. In the use of the above-mentioned plug rods consisting usually of metal in inductively heated melting and casting furnaces, an undesired heating of the plug rod occurs due to the excitation of the metal part of the rod by the induction field of the furnace.

The plug rods are usually actuated by hydraulic jacks which are disposed within the vacuum chamber. The oil fog caused by the piston rod of the hydraulic jack within the vacuum chamber is of no great importance in most cases. For the melting and casting of high-purity metal alloys, however, the oil fog within the vacuum chamber is a great disadvantage and can result in contamination of the molten metal.

The present invention provides reliable opening and closing of the bottom tap opening, while preventing undesired heating of the plug rod and contamination within the furnace by the accessory equipment, which may cause an oil fog.

According to the invention, the plug rod is made of ceramic material, and is connected by levers to a coupling means which has a compression spring to limit the maximum closing force of the closure body, and can be displaced by an electric motor drive. Advantageously, this permits a reliable opening and closing of the bottom tap opening, prevents the heating of the plug rod, and prevents interference with the melting of high-purity metal alloys by oil fog within the vacuum chamber.

DETAILED DESCRIPTION OF THE PREFERRED EMBODIMENT

Figure 1:
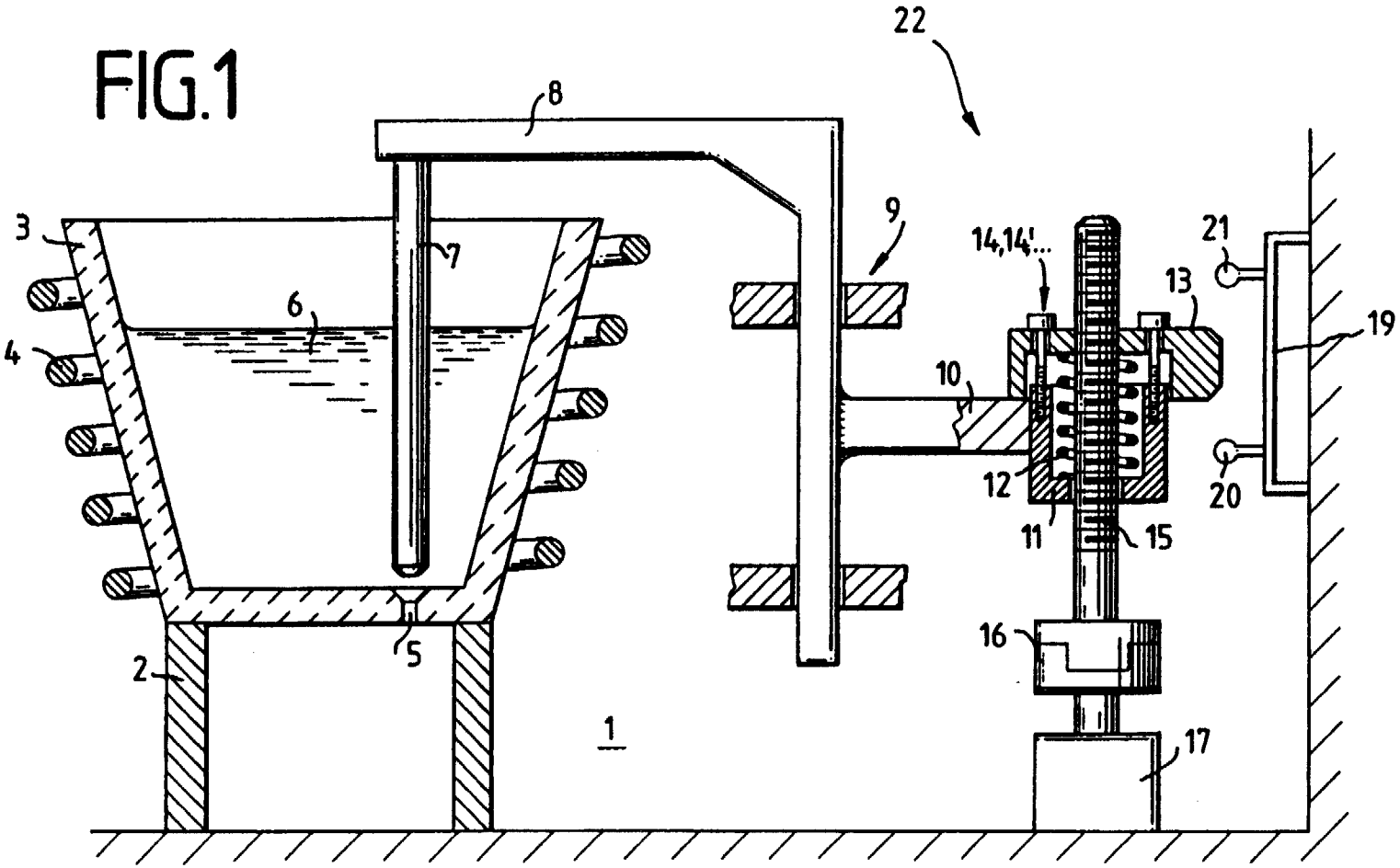
FIG. 1 is a sectional view of a melting and casting crucible with invention, consisting essentially of a plug rod, a boom and a spindle drive powered by an electric motor.
Figure 1A:
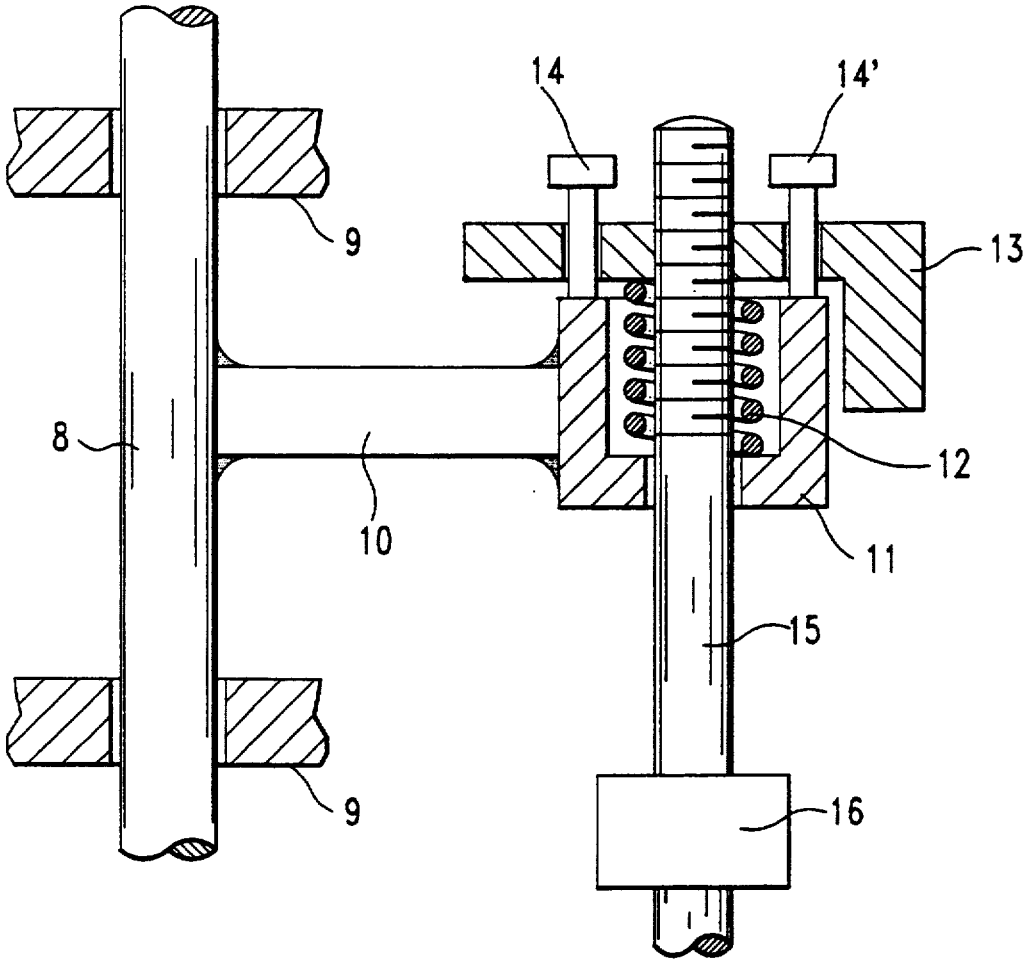
FIG. 1A is an enlarged sectional view of the device when the plug rod is in the pouring opening of the crucible.

As FIG. 1 shows, on the bottom of a vacuum chamber 1 there is a stand 2 on which the melting and casting crucible 3 is placed. The crucible 3 is surrounded by an induction coil 4 and has a bottom pouring opening 5 through which the molten metal 6 in the crucible is poured out. The opening 5 can be closed by a cylindrical plug rod 7 which at its upper end extending out of the molten metal is affixed to a boom 8. The boom 8 is held at its vertical part in the guide 9 and is fixed to horizontal beam 10; the carrier 11 is fixed to the other end of horizontal beam 10. Fixing is preferably done by welding the beam 10 to boom 8 and carrier 11. A cylindrical compression spring 12 is inserted into the carrier 11. A spindle sleeve 13 having a threaded bore is placed on the upper end of the compression spring 12 and is driven vertically relative to the carrier 11 as the threaded spindle 15 is rotated in the bore and the spring 12 is compressed. Relative vertical movement is limited by stop-bolts 14, 14' as shown in FIG. 1. The spring 12 is shown compressed in FIG. 1A; this is the condition when the plug rod 7 is seated in orifice 5. The carrier 11, the spring 12, and the spindle sleeve 13 have a common axis of rotation on which the spindle 15 is also disposed. The top end of the spindle 15 is threaded in sleeve 13 and the bottom end is connected by a coupling 16 to the electric motor 17. On the wall 18 of the vacuum furnace chamber 1 is a bracket 19 with a vertical rail on which the two limit switches 20 and 21 are fastened. These switches 20 and 21 are actuated by the two chamfers on the spindle sleeve 13. All of the parts mounted above the motor 17 are generally designated as the drive unit 22.

Figure 2:
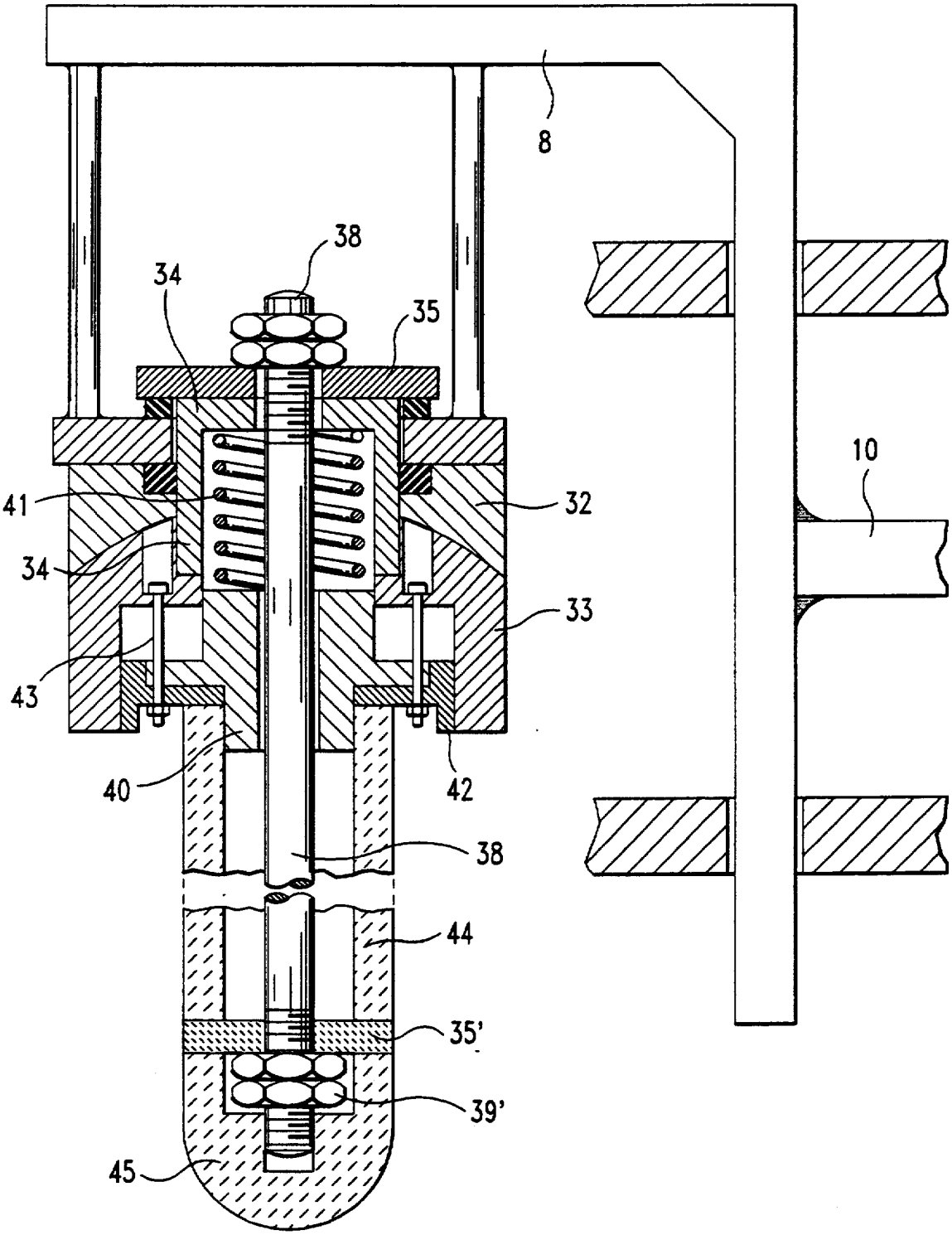
FIG. 2 is a section of a plug rod mounting with alignment equalization.

FIG. 2 shows an alternative embodiment wherein the plug rod includes a ceramic sleeve 44 and an end cap 45 with an intervening disk 35' held together by cement. Additional retention is provided by threads on the end of tension rod 38, which cooperate with threads in cap 45 to fix it in the plug rod, and nuts 39' bearing against disk 35'. The rod 38 may be high grade steel or graphite.

The tension rod is fixed relative to sleeve 40 and annular plate 42, which is slidably mounted in a stepped central bore of joint part 33. A cylindrical sleeve 34 is fixed in the upper part of the stepped bore, and contains a coil spring 41 which urges the sleeve 40 downward relative to the joint part 33. Relative motion is limited by bolts 43 in the same fashion as bolts 14, 14' shown in FIGS. 1 and 1A.

As the boom 8 is lowered by the action of a motor (not shown), an upper joint part 32 bears against the lower joint part 33 when the ceramic end cap is seated in a pouring opening of the crucible. This causes the joint parts 32, 33 to move downward relative to the sleeve 40, compressing the spring 41 as the bolts 43 "rise" through countersunk bores in the lower joint part 33. The tension rod 38 will also "rise" through sleeve 34 and top cover 35. That is, the rod 38 becomes stationary when the pouring opening is closed, and the sleeve 34 and cover 35 move downward relative thereto as spring 41 is compressed.

The embodiment of FIG. 2 also compensates for misalignments between the pouring opening and the plug rod. If the rod is not properly aligned, the joint part 33, which is configured as a ball, will rotate in joint part 32, which is configured as a socket. This feature is shown in greater detail in FIG. 2A.

Figure 2A:
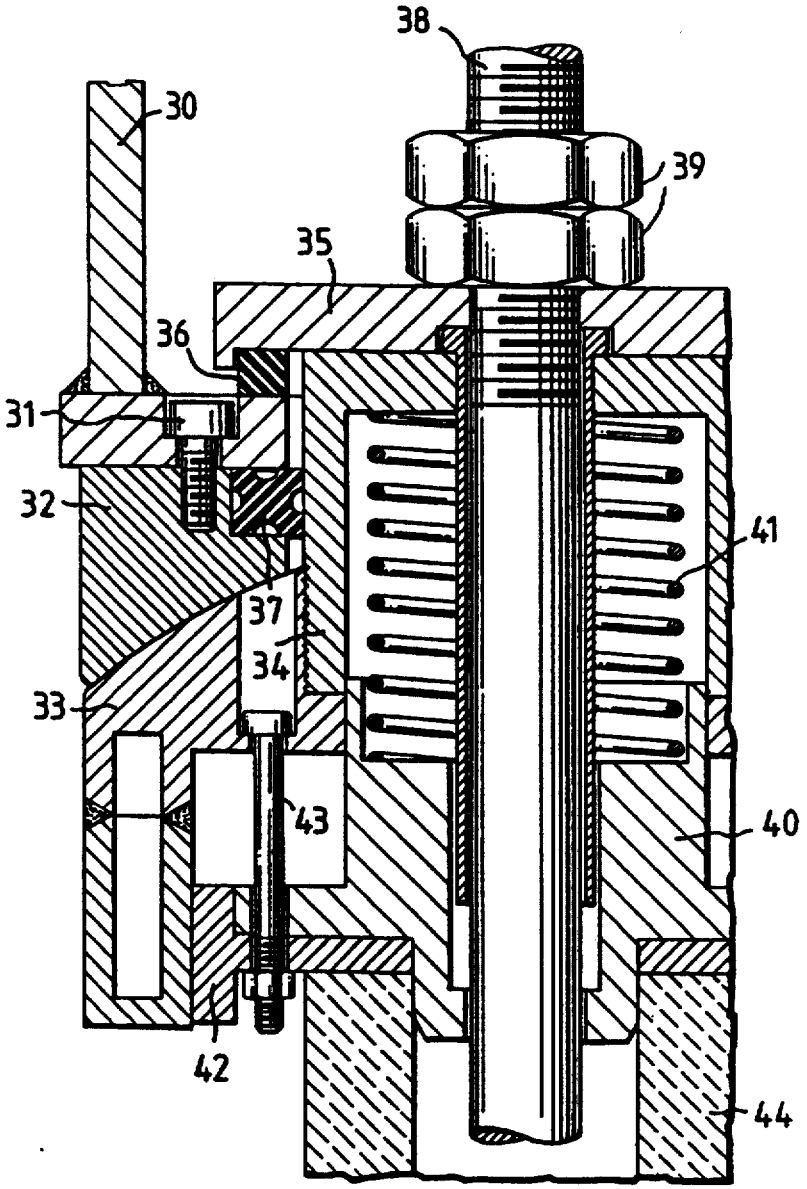
FIG. 2A is an enlarged sectional view of the alignment device of FIG. 2.

Referring to FIG. 2A, a hollow hemispheric upper joint part 32 is fastened on boom 30 by means of the screw 31. A joint part 33 matching it is bolted to a cylindrical sleeve 34. On the sleeve 34 there is a disk-shaped cover 35 which is placed on a rubber pressure ring 36 on the annular part of the boom 30. In a radially inner groove in the upper joint part 32 there is placed a rubber quad ring 37 which in turn radially encircles the sleeve 34.

In a central bore of the cover 35 and of the sleeve 34 there is an upright tension rod 38, which is fastened on top of the cover 35 by means of a pair of nuts 39. On the tension rod 38 there is furthermore a sleeve 40 which holds a compression spring between its top and a flange of the sleeve 34. The sleeve 40 is adjoined at the bottom by a plate 42 which is fastened to the hemispheric joint part 33 by the screw 43. The tension rod 38 is surrounded below the plate 42 by a hollow cylindrical ceramic sleeve 44. This sleeve 44 is clamped at its bottom end to the tension rod 38 by a pair of nuts 39', 35' (FIG. 2).

If misalignment occurs during downward movement of boom 30, the ball 32 will rotate in socket 33, causing the rubber ring 37 to be compressed on one side. The ring 37 also provides a resilient centering action when the boom 30 is raised.

The foregoing is exemplary and not intended to limit the scope of the claims which follow.

We claim:

1. Apparatus for opening and closing a bottom tap opening in a melting crucible, said apparatus comprising plug rod means which is movable vertically, said plug rod means having an end which closes said opening, carrier means fixed relative to said plug rod means, driven means which is vertically displaceable relative to said carrier means, spring means urging said driven means away from said carrier means, limiting means which limits possible displacement of said driven means from said carrier means, and drive means for driving said driven means vertically.

2. Apparatus as in claim 1 wherein said drive means comprises an electric motor and a threaded spindle which is rotated by said motor, said driven means comprising a threaded bore which receives said spindle.

3. Apparatus as in claim 1 wherein said spindle is received through said carrier means, said spring means comprising a coil spring between said carrier means and said driven means.

4. Apparatus as in claim 3 wherein said coil spring is coaxial to said spindle.

5. Apparatus as in claim 1 wherein said limiting means comprises bolt means fixed to one of said carrier means and said driven means and passing through bore means in the other of said carrier means and said driven means.

6. Apparatus as in claim 1 wherein said carrier means comprises a boom between said plug rod means and said drive means.

7. Apparatus as in claim 1 wherein said driven means comprises a boom between said plug rod means and said drive means.

8. Apparatus as in claim 7 wherein said driven means comprises a platform above said plug rod, said limiting means comprises a tension rod fixed to said plug rod and extending through said platform, said limiting means further comprising nut means threaded on said tension rod above said platform, and said spring means comprises a coil spring coaxial to said tension rod between said plug rod and said platform.

9. Apparatus as in claim 8 further comprising a first ball joint part having a hemispherical surface and a bore therethrough, a sleeve fixed in said bore and extending upward from said hemispherical surface, said sleeve slidably receiving said carrier means therein, and a second ball joint part having a hemispherical surface fixed against said hemispherical surface of said first ball joint part, said second ball joint part having a bore therethrough which receives said sleeve with clearance.

10. Apparatus as in claim 9 further comprising a resilient ring in said bore of said second ball joint part between said second ball joint part and said sleeve.

11. Apparatus for opening and closing a bottom tap opening in a melting crucible, said apparatus comprising inductive heating means for melting metal in said crucible, plug rod means having a lower end which closes said opening when moved vertically thereagainst, said plug rod means comprising a tension rod made of graphite and a hollow cylindrical ceramic sleeve surrounding said tension rod, first ball joint means carrying said plug rod, second ball joint means fitted against said first ball joint means to permit relative rotation so that the end of said plug rod is movable laterally to compensate for misalignment with said opening, and drive means for moving said second ball joint means vertically.

12. Apparatus as in claim 11 wherein said tension rod has an upper end which extends beyond said ceramic sleeve, said apparatus further comprising a cover fastened to the upper end of the tension rod and a compression spring between said cover and said ceramic sleeve, said sleeve being movable vertically relative to said cover, said spring urging said sleeve away from said cover.

13. Apparatus as in claim 12 further comprising stop means which limits movement of said sleeve away from said cover.

14. Apparatus as in claim 11 wherein said plug rod comprises a lower end closed by a ceramic end cap.

15. Apparatus as in claim 1 further comprising inductive heating means for melting metal in said crucible, said plug rod being made of ceramic material.

* * * * *